United States Patent [19]

Haas

[11] 4,136,706

[45] Jan. 30, 1979

[54] HAIR ROLLER

[75] Inventor: David L. Haas, Norwalk, Conn.

[73] Assignee: Sperry Rand Corporation, Bridgeport, Conn.

[21] Appl. No.: 741,921

[22] Filed: Nov. 15, 1976

[51] Int. Cl.[2] ..... A45D 2/00

[52] U.S. Cl. ..... 132/40; 229/41 R

[58] Field of Search ..... 132/40, 39, 42; 229/41 B, 41 C, 93, 41 R

[56] References Cited

U.S. PATENT DOCUMENTS

| | | | |
|---|---|---|---|
| 2,180,841 | 11/1939 | Vogt | 229/4 R |
| 2,226,178 | 12/1940 | Page | 229/41 B |
| 2,369,385 | 2/1945 | Carruth et al. | 229/41 B |
| 2,402,944 | 7/1946 | Braloff | 229/41 B |
| 2,551,090 | 5/1951 | Bergstein | 229/41 R |
| 2,965,280 | 12/1960 | Miller | 229/41 C |
| 3,498,300 | 3/1970 | Lehn | 132/40 |
| 3,708,603 | 10/1963 | Mobberley | 132/34 |

*Primary Examiner*—G. E. McNeill

*Attorney, Agent, or Firm*—Charles R. Miranda

[57] ABSTRACT

An improved hair roller is disclosed which is adapted to be stored in a substantially flat configuration and to be expanded into a body having a cylindrically shaped configuration which is substantially resistant to bending and buckling. The hair roller comprises first and second sleeve shaped bodies, one of which is dimensioned to be telescopically positioned within the other and the bodies are adapted to be mutually rotated for forming and maintaining a cylindrically shaped configuration.

7 Claims, 6 Drawing Figures

HAIR ROLLER

BACKGROUND OF THE INVENTION

This invention relates to hair rollers and, more particularly, to an improved form of cylindrically shaped hair roller which may be stored flat.

The use of rollers for the styling and setting of hair is well known. In one arrangement, a hair roller bdy which is generally cylindrically shaped is provided and a person's hair is wound about and secured to the roller body. The hair thus formed on the roller body can be warmed to enhance setting. Alternatively, the hair remains wound about the curling body for an extended period of time to achieve setting under ambient air conditions.

The use of hair rollers is facilitated when the cylindrically shaped roller body is substantially resistant to bending and buckling. However, it is also desirable for the purposes of packaging by the manufacturer and storage by the user to provide a roller of this type which can be stored in a substantially flat configuration.

As disclosed in copending U.S. patent application Ser. No. 741,611 which is filed concurrently herewith and which is assigned to the assignee of this invention, the desired results are achieved by providing at least two generally planar shaped roller members which are hinge coupled and expandable into a body having a generally cylindrically shaped configuration and means for maintaining the body in its cylindrical configuration.

It is an object of this invention to provide another form of improved hair roller which can be stored in a generally flat configuration, which can be expanded into a generally cylindrically shaped configuration, but which utilizes two independent bodies which cooperate to provide these characteristics.

SUMMARY OF THE INVENTION

In accordance with features of this invention, a hair roller is provided which is adapted to be stored in a substantially flat configuration and to be expanded into a body having a cylindrically shaped configuration, which is substantially resistant to bending and buckling and which is provided by first and second independent bodies. A first generally rectangular shaped envelope body is provided having first and second, planar shaped, flexible members which are hinge coupled along elongated edges whereby the members are resiliently deflectable into a body having a generally cyindrically shaped configuration. This first envelope body has an axis extending through the hinged couped edges and when expanded, the axis comprises a substantially diametral axis of a cross section of the body. The second body is generally rectangular shaped and includes first and second planar shaped flexible members which are hinge coupled along elongated edges whereby the members are resiliently deflectable into a body having a generally cylindrically shaped configuration. The second body has an axis extending through the hinge coupled edges and when expanded, the axis comprises a substantially diametral axis of a cross section of the body. The second body is dimensioned for positioning within the first envelope body to provide a generally flat telescoping assembly of the second body in the first body when the axes are substantially parallel and an elongated cylindrically shaped body which is substantially resistant to bending and buckling when the bodies are mutually rotated for providing that the axes are substantially normal. This arrangement is advantageous in that it eliminates intercoupling between the bodies thereby extending their usefulness, simplifies the manufacture and production of the hair roller, and to a limited extent, permits adjustment of the length of the hair roller.

BRIEF DESCRIPTION OF THE DRAWINGS

These and other objects and features of the invention will become apparent with reference to the following specification and to the drawings wherein.

Figure 1:
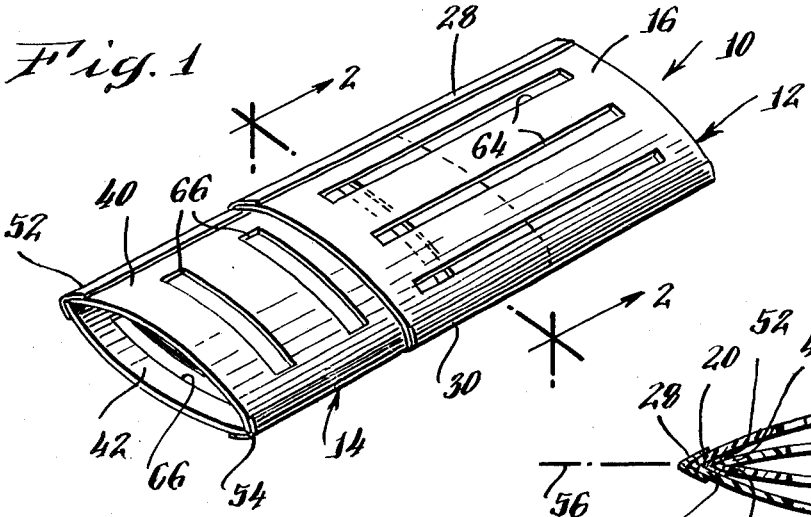
FIG. 1 is a perspective view of a hair roller constructed in accordance with features of this invention.
Figure 6:
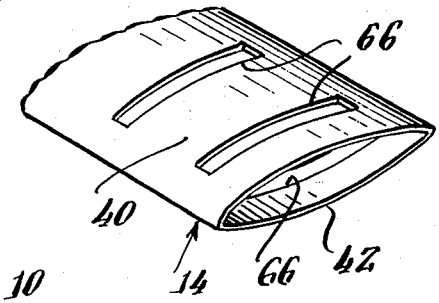
Figure 4:
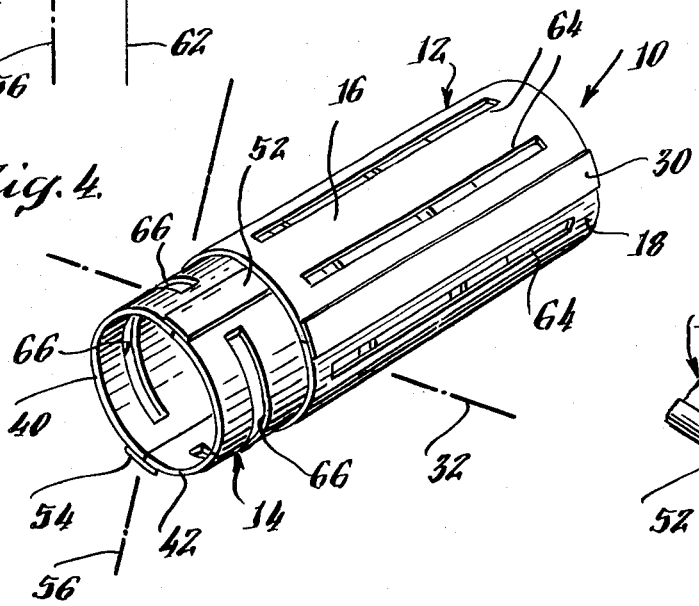
Figure 5:
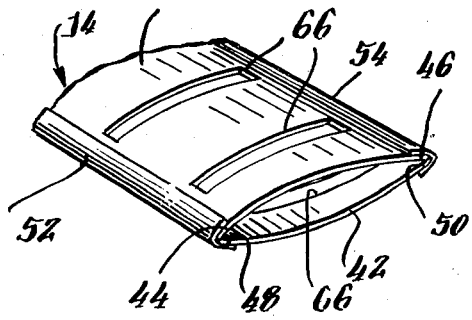

FIG. is a perspective view illustrating an intermediate step in the process of expanding the hair roller from a generally flat configuration into a hair roller having a generally cylindrically shaped configuration;

FIG. 4 is a perspective view illustrating the cylindrically shaped hair roller configuration of this invention;

FIG.5 is a fragmentary, perspective view of one embodiment of the construction of a body of the hair roller of FIG.1; and, FIG. 6 is a perspective, fragmentary view of an alternative embodiment of the construction of a body of FIG. 1.

DETAILED DESCRIPTION

Figure 2:
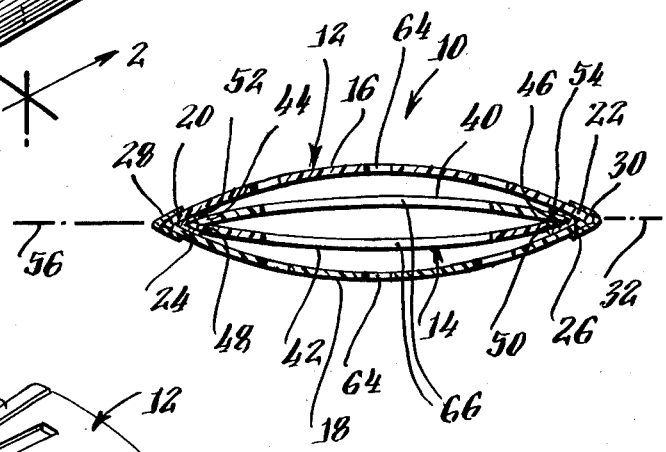
FIG. 2 is an enlarged sectional view taken along plane 2—2 of FIG. 1.

Referring now to the drawings, there is illustrated in FIG. 1 a hair roller 10 which is adapted to be stored in a substantially flat configuration as illustrated in FIG. 1 and to be expanded into an elongated, cylindrically shaped body as illustrated in FIG. 4 which is substantially resistant to bending and buckling. The hair roller 10 comprises a first generally rectangular shaped envelope body 12 and a second generally rectangular shaped body 14. The first body 12 is formed by first and second flexible, planar shaped members 16 and 18. The member 16 has first and second elongated longitudinally extending edges 20 and 22 respectively and the member 18 has first and second elongated longitudinally extending edges 24 and 26 respectively. A hinge coupling means is provided comprising an elongated adhesive strip 28 for hinge coupling the edges 20 and 24 along their length in alignment, and, an elongated adhesive strip 30 for hinge coupling the edges 22 and 26 along their length in alignment. The adhesive strips 28 and 30 have surfaces which are positioned adjacent to and adhere to edge segments of the members 16 and 18. Hinge coupling enables deflection of the members 16 and 18 into a generally cylindrically shaped configuration. In the undeflected configuration as illustrated in FIGS. 1 and 2, an axis 32 extends through the hinge coupled edges. As illustrated in FIG. 4, when the member 16 and 18 are deflected into a generally circular configuration, the axis 32 comprises a diagonal of a circular cross sectional configuration formed by the members 16 and 18.

The second body 14 is formed by first and second planar shaped members 40 and 42 respectively. The member 40 has first and second longitudinally extending edges 44 and 46 respectively and the member 42 similarly has first and second longitudinally extending edges 48 and 50 respectively. A hinge coupling means is provided and comprises an adhesive strip 52 and an adhesive strip 54. The strip 52 has an adhesive surface positioned adjacent to and in contact with an edge segment of the member 40 and an edge segment of the member 42 to provide a hinge coupling between the edges 44 and 48. The adhesive strip 54 has a surface adjacent to and adhering to the edge segment of the member 40 and an edge segment of the member 42 to provide a hinged coupling between the edges 46 and 50. The hinged couplings enable the resilient deflection of the members 40 and 42 into a body having a generally cylindrically shaped configuration. An axis 56 extends through the hinge coupled edges of the members 40 and 42 and when these members are deflected into a circular cross sectional configuration of the cylindrical body, the axis 56 comprises a diametral axis of the circular cross section.

The body 14 is dimensioned for extending into the body 12 and providing a generally flat, telescoping assembly of the bodies as is illustrated in FIG. 1 when the axis 32 and 56 are substantially parallel.

Figure 3:
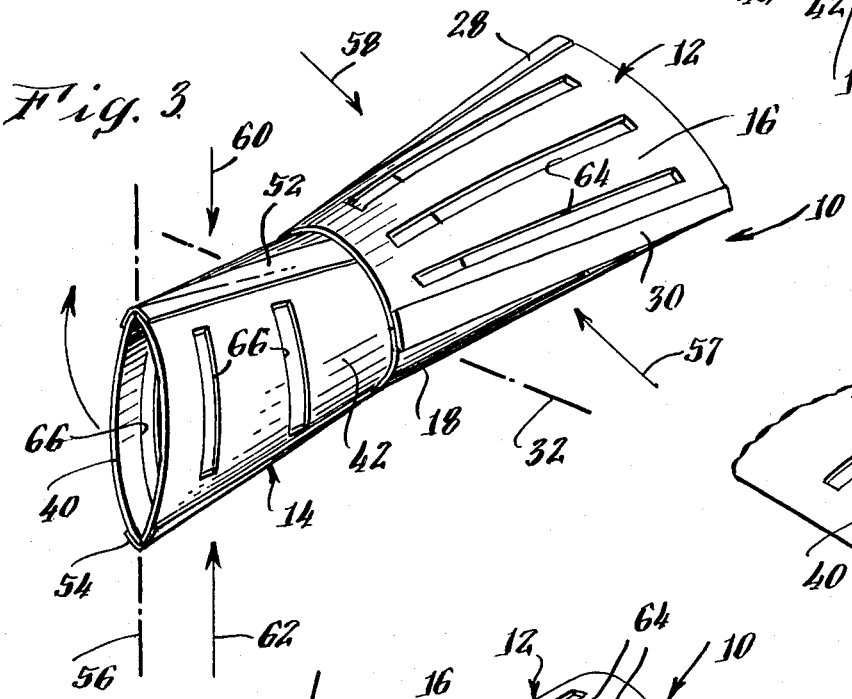

By withdrawing a substantial part of the length of the body 14 from the body 12 as illustrated in FIG. 1 and by deflecting the body 12 into a cylindrical configuration through the application of finger force to the body 12 in the direction indicated by the arrows 57 and 58 (FIG. 3), the bodies 12 and 14 can mutually be rotated. The bodies are rotated until the axes 56 and 32 are substantially normal. By maintaining a force in the direction of the arrows 57 and 58 with one hand and by applying with the other hand a force in the direction of the arrows 60 and 62 (FIG. 3), the body 14 is conformed to a cylindrical configuration. Introduction of the cylindrically conformed body 14 into the body 12 maintains the hair roller in a generally cylindrical shaped configuration as illustrated in FIG. 4. The cylindrical configuration is maintained since the bodies 12 and 14 are exerting resilient forces on each other in directions normal to their axes which operate to resist relaxation of the deflected bodies and to maintain each of them in a circular configuration. A force is applied by the body 12 on the outer surface of the body 14 while a force is applied on the inner surface of the body 12 by the outer surface of the body 14.

Apertures are formed in the roller members 12 and 14 in order to enhance the flow of air through the roller and to enhance the application of hair treatment materials to hair wound about the roller. In accordance with features of the invention, the apertures in the body 12 comprise a plurality of elongated slots 64 extending in the direction of the length of the member 12 while the apertures in the body 14 comprise elongated slots 66 extending in a direction normal to the length of the member 14. By providing slotted apertures, the bodies 12 and 14 can be rotated without consideration for mutual alignment of the apertures in the members as would be the case with circular apertures. Perpendicular orientation of the slotted apertures is preferred but not necessary since, for example, by forming the slots 64 and 66 with mutual angular orientations greater than 0° or 180°, desired air flow passages through the walls of the roller will be provided.

The bodies 12 and 14 are formed of flexible planar members which are hinge coupled by adhesive tape as is illustrated in FIG. 5. The adhesive strips 28, 30, 52 and 54 have a thickness, for example, of about 0.005 inches (0.013 cm. This provides a non-interfering contact between surfaces and the strips. In FIGS.1–5, the thickness of these strips is exaggarated for clarity in the drawings. The members can alternatively be hinge coupled through the use of strips which are heat sealed to the members. Alternatively, the members of a body and the hinge coupling means may be integrally formed by fabricating a body of a tubular material which is flattened as is illustrated in FIG. 6.

The resilient deflectivity characteristics of a body is provided by forming the body of suitable material and thicknesses. Various materials will provide the desired characteristics. One suitable material comprises a polymer plastic such as propylene having a thickness in the range of about 0.005 inches to 0.010 inches (0.013 cm to 0.025 cm).

An improved hair roller has been described which advantageously eliminates intercoupling between bodies thereby enhancing the reusability of the hair roller, simplifying the manufacture and cost of the hair roller, and to a limited extent, permitting adjustment of the length of the hair roller.

While I have described a particular embodiment of my invention, it will be apparent to those skilled in the art that variations may be made thereto without departing from the spirit of the invention and the scope of the appended claims.

What is claimed is:

1. A hair roller resiliently expandable from a substantially flat storage configuration into an elongated generally cylindrical-shaped body which is substantially resistant to bending and buckling to externally applied finger force and which can be readied for use by mutual rotation of a pair of hinge coupled bodies arranged in a telescoping assembly, said hair roller comprising;

a. two resiliently flexible, rectangular-shaped, substantially flat, body members having substantially the same length and width, b. each of said body members having opposed corresponding marginal portions terminating in longitudinally extending edges, said body members being arranged in an overlying relationship with said longitudinal edges of one of the body members in an aligned coextensive relationship with the corresponding longitudinal edges of the other body member, c. means secured to said marginal portions of the body members for hinge coupling said body members to each other along said aligned coextensive edges and forming a first substantially flat hinge coupled body, said hinge coupled body having an axis extending through said opposed hinge coupled longitudinal edges transverse of said body members, d. a second substantially flat hinge coupled body constructed in the same manner as said first hinge coupled body and dimensioned for insertion between the overlying body members of the first hinge coupled body, said first and second hinge coupled bodies being arranged in telescoping assembly in said generally flat configuration with the transverse axis of the first hinge coupled body and the transverse axis of said second hinge coupled body aligned in substantially the same plane, e. said first and said second hinge coupled bodies being resiliently deflectable under externaly applied finger force and mutually rotatable for positioning said bodies with said transverse axes at a substantially normal relationship to each other forming a hair roller having a generally cylindrical-shaped configuration, f. said second hinge coupled body resiliently engaging said first hinge coupled body in said substantially normal relationship of the axes for maintaining said hair roller in said cylindrical-shaped configuration with said transverse axes forming diametrical axes of said cylindrically-shaped hair roller.

g. said hair roller assuming said substantially flat configuration upon mutual rotation of said hinge coupled bodies to said substantially same plane arrangement of said transverse axes.

2. The hair roller of claim 1 wherein said hinge coupling means are integrally formed with said body members.

3. The hair roller of claim 1 wherein said hinge coupling means include elongated strip members arranged in bridging relationship to said corresponding longitudinal edges and secured to the marginal portions of the body members.

4. The hair roller of claim 3 wherein said strip members have a first surface and said marginal portions have a first surface and the strip members are secured to the body members with said first surface of the strip members in contact with said first surface of the marginal portions of the body members.

5. The hair roller of claim 4 wherein said strip members are secured to said body members by heat seaing the strip members to the body members.

6. The hair roller of claim 4 wherein said strip members are secured to said body members by adhesive means positioned between the first surfaces of said strip members and said marginal portions.

7. The hair roller of claim 1 wherein a plurality of elongated slots are formed in each of the body members of said hinge coupled bodies, the elongated slots in one of said hinge coupled bodies extending in a direction of a length thereof, the elongated slots in the other of said hinge coupled bodies extending in a direction normal to a length thereof and the elongated slots of said one hinge coupled body overlapping the slots of said other hinge coupled body forming a plurality of airflow passages extending through the walls of the hair roller irrespective of the relative angular or linear positioning of said one hinge coupled body to said other hinge coupled body.

* * * * *